United States Patent [19]

Lambert, Jr.

[11] 4,149,714

[45] Apr. 17, 1979

[54] SEATED WEIGHT LIFTING LEG PRESS EXERCISE MACHINE

[76] Inventor: Lloyd J. Lambert, Jr., 1538 College Ave., South Houston, Tex. 77587

[21] Appl. No.: 819,995

[22] Filed: Jul. 28, 1977

[51] Int. Cl.[2] ..... A63B 21/06

[52] U.S. Cl. ..... 272/118; 272/134; 272/144

[58] Field of Search ..... 272/118, 144, 117, 116, 272/DIG. 4, 134; 197/114 R, 186 R, 186 A, 186 B; 74/137, 140, 103, 104

[56] References Cited

U.S. PATENT DOCUMENTS

| | | | |
|---|---|---|---|
| 1,128,911 | 2/1915 | Smith | 74/140 X |
| 2,675,236 | 4/1954 | Blickman | 272/118 X |
| 3,116,062 | 12/1963 | Zinkin | 272/118 |
| 3,734,495 | 5/1973 | Nist et al. | 272/118 |
| 3,820,782 | 6/1974 | Salkeld | 272/118 |
| 3,912,261 | 10/1975 | Lambert | 272/118 |
| 3,917,262 | 11/1975 | Salkeld | 272/118 |

*Primary Examiner*—Richard C. Pinkham
*Assistant Examiner*—William R. Browne
*Attorney, Agent, or Firm*—Victor J. Evans

[57] ABSTRACT

Disclosed herein is a seated leg press exercise machine comprising a seat which is adjustable on a trackway, a pair of foot platforms associated near the seat to allow one's feet to be placed thereon, a pivotal bar connecting these foot pedals so that horizontal displacement of one extremity of this pivot bar not only swings about an arc caused by the pivot, but is also connected at the extremity remote from the pivot with a linkage which indirectly lifts a pre-selected magnitude of weights. The indirect linkage includes a chain running through series of gears, a shaft fastened to one of the gears, a cam member attached to the shaft, a cable attached to the cam, and weights attached to the cable. Therefore, when the pedals are displaced in a horizontal sense, the linkage follow and react with this motion, and exercise work is done against the weights. Supporting the linkages, weights, seats and foot pedals is a framework.

6 Claims, 3 Drawing Figures

SEATED WEIGHT LIFTING LEG PRESS EXERCISE MACHINE

BACKGROUND OF THE INVENTION

Field of the Invention

The art of weight lifting has progressed and increased in popularity remarkably over the last few years, and along with this increase in popularity there has been a greater regard for the safety of the people who utilize this machinery. Tradicational leg pressing machinery included a bench upon which a person is disposed and a weight bar disposed overhead in a trackway in such a manner that when the legs of the person using the machine pushed upon the bar, work would be done against the weights in a vertical sense. The problems associated with this type of weight machine for legs includes the fear of using this machine unattended, since an inordinate or excessive amount of weight would cause the person's legs to be folded against their chest, and unable to move from underneath the weights.

In addition, the science of weight lifting has developed to the point where specific machines have been developed to exercise specific muscles in the leg. To this end, the body member to be exercised is constrained so that it can only move in one direction, thereby assuring that the muscle to be developed is worked, and the likelihood of cheating on the weight lifting, by calling other muscles into play, has been minimized.

Accordingly, disclosed herein is a weight lifting machine specifically designed for a leg press exercise in which the specific muscles desired to be developed are worked to the exclusion of every other muscle.

In addition the following detailed specification will provide a teaching wherein a minimum amount of supervision when using the machine is afforded, since the machine is extremely safe to use and provides no hazard to the weight lifter.

Further, disclosed herein is a machine which makes attractive and relatively easy the working of specific leg muscles.

Other objects and advantages will become apparent in the following specification when considered in light of the attached drawings.

DESCRIPTION OF THE PREFERED EMBODIMENT

Figure 1:
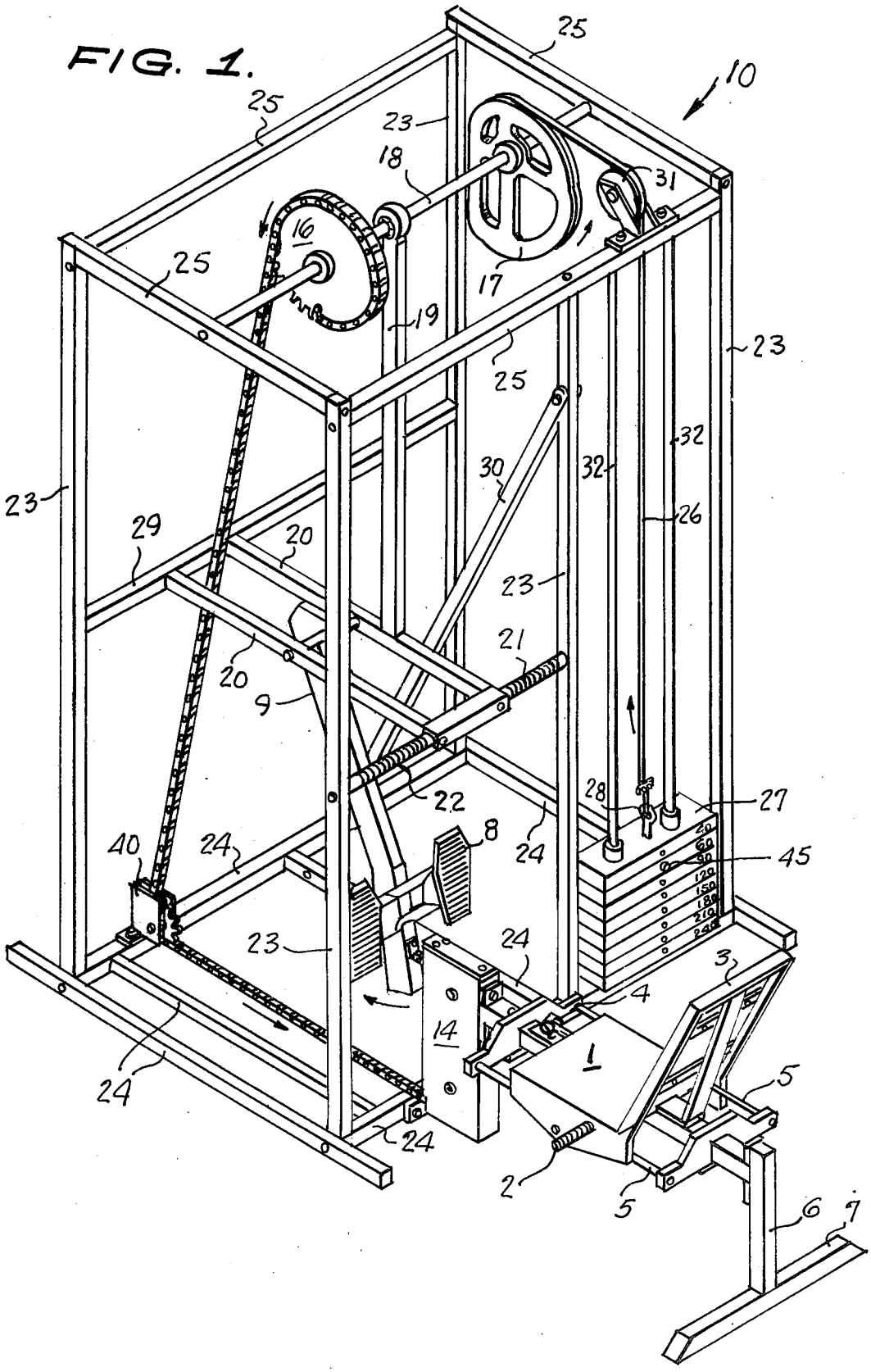
FIG. 1 shows a three quarter view of the apparatus according to the invention.
Figure 2:
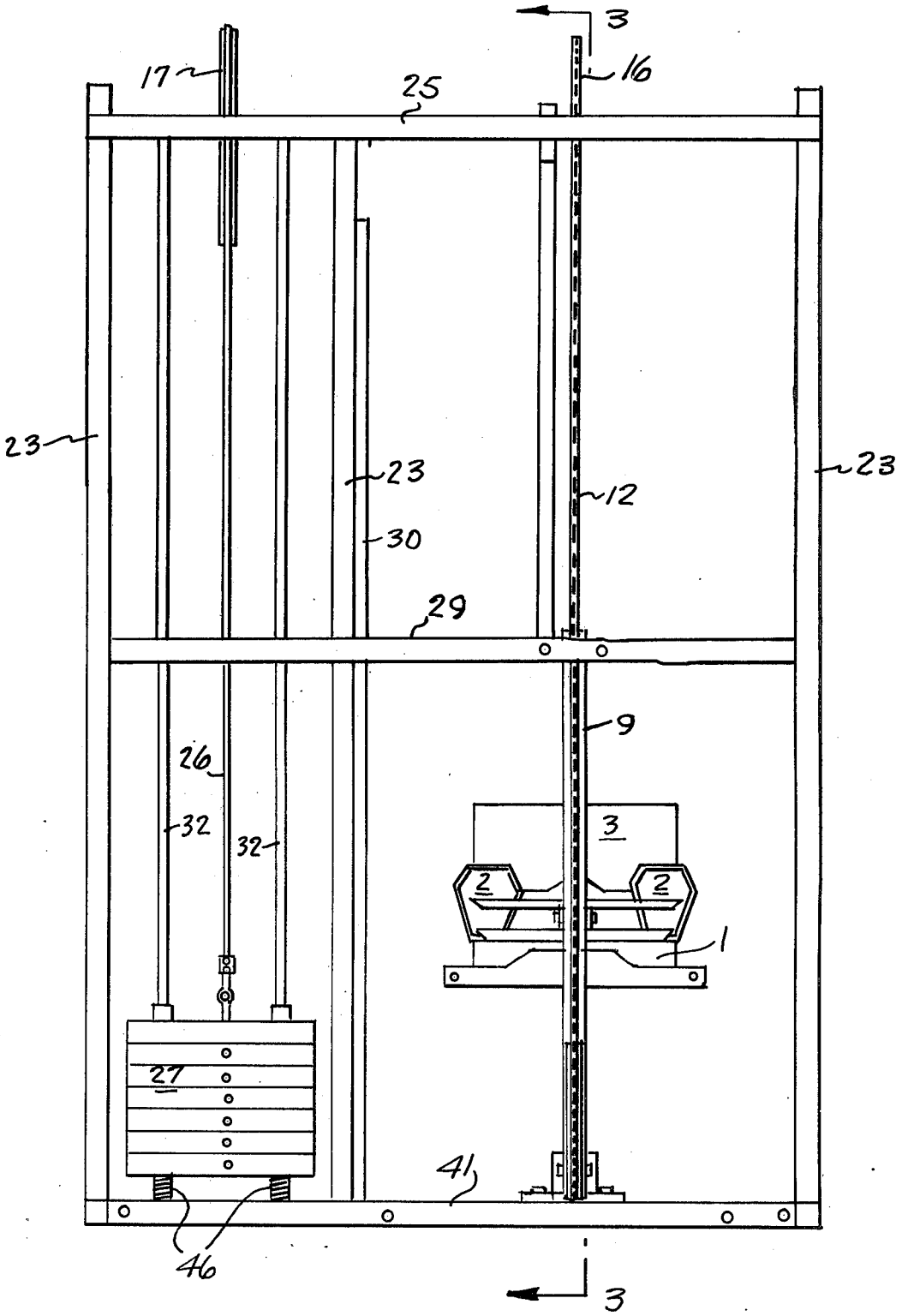
FIG. 2 is a back view thereof.

Referring to the drawings now, in which like reference numerals refer to like parts throughout reference numeral 10 of FIG. 1 generally denotes the seated leg press exercise machine of the present invention.

Leg press machine 10 is generally comprised of a framework denoted by 5 vertically upstanding support bars 23 fastened at their extremities by rectangular grid 25 on the top portion and base support members 24. In FIG. 1 it is shown that there are six base support members to provide resistance against any torsions which occur during the use of the machine, and to that end cross brace member 30 is deployed from one of the rearward base support members 24 to one of the vertical support poles 23.

Figure 3:
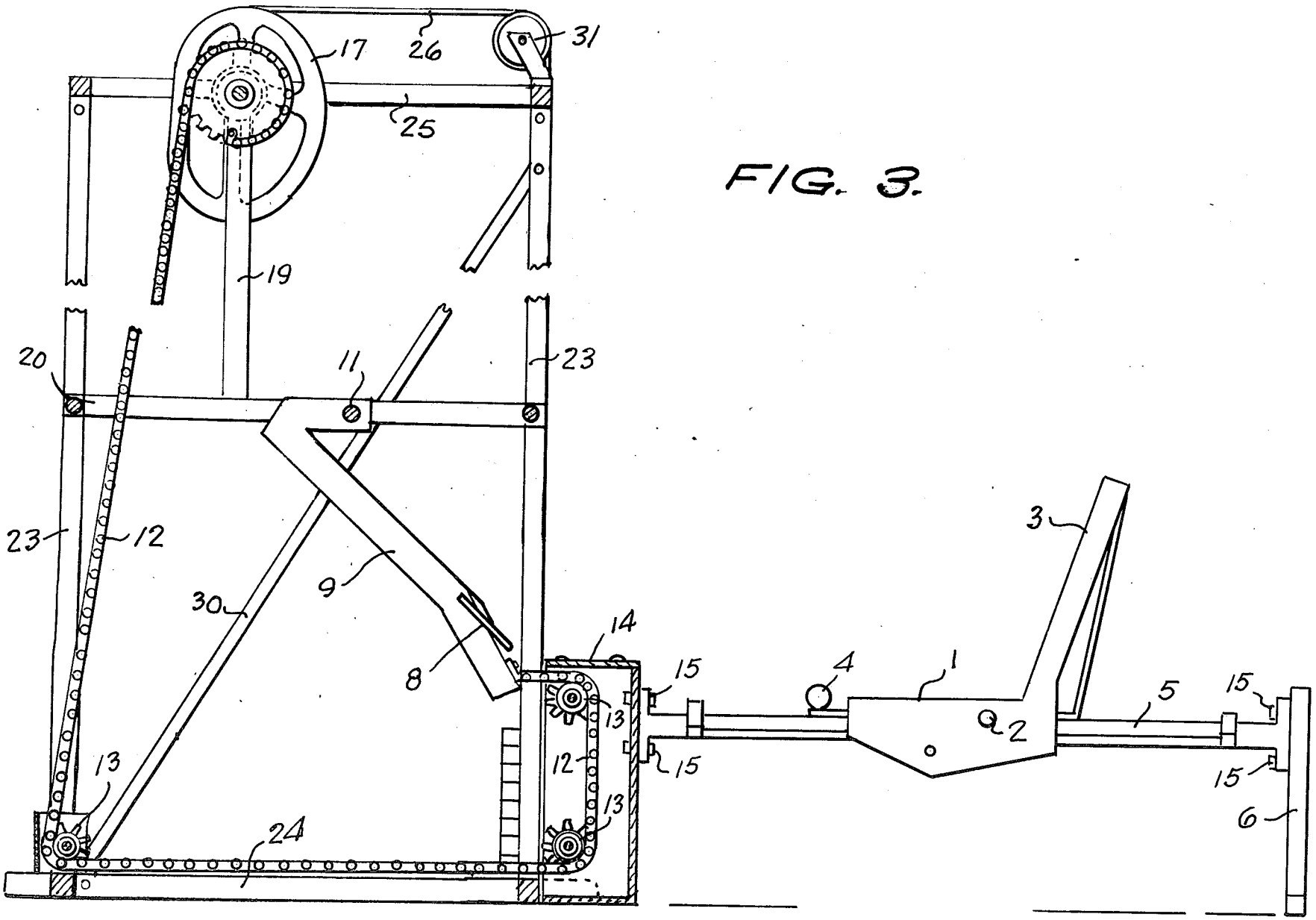
FIG. 3 is a sectional taken along lines 3—3 of FIG. 2.

Substantially medially disposed along the vertical support poles 23 is a second framework denoted by bars 20, 21, 22 and 29 which provide support for not only the framework, but also the pivoted pedal link 9. Link 9 as best seen in FIG. 3 is generally of the shape of a backward 7, and it is pivoted to support bars 20 through a rod 11. Rods 20 of course are attached to bar 29 which is horizontally disposed between a pair of the vertical poles 23, and at the other extremity bars 20 are connected to another pair of vertical bars through horizontal bars 21 and 22. These bars 21 and 22 can serve as a hand grip and to that end they provide a surface which would accomodate ones hands in a positive grip like fashion. As an alternative, the seat 1 to be described later is also provided with handles 2. At the other extremity of pivot bar 9 are disposed a pair of foot pedals or platforms 8 which serve to support the feet of the exerciser. Near these foot platforms 8 and connected to the lower extremity of pivot bar 9 is a chain 12 which extends towards the seat 1 and into a casing 14. Disposed within casing 14 is a pair of gears 13 which change the direction of motion of the chain from a substantially horizontal direction to a vertical one. The lower most gear 13 changes the direction of chain 12 from a vertical disposition to a horizontal one backwardly to the rear of the framework. Thereafter the chain changes direction again from a horizontal one to a substantially vertical position and terminates on gear wheel 16 located within and supported by the upper frame grid 25 while being disposed on shaft 18. The connection between gear wheel 16 and shaft 18 is a rigid one, so that as gear wheel 16 rotates so to does shaft 18. To this end, bearings are disposed at the extremities of shaft 18 where they meet two of the upper support grids 25. Extending downwardly from shaft 18 is a further support bar 19 which is in turn connected to one of the horizontal support members 20 which serves in turn to provide support for the pivot arm 9, and the upper extremity of support arm 19 has a bearing disposed herein so that shaft 18 can rotate smoothly within that portion of bar 19 without any undue friction. Remote from gear 16 and secured to shaft 18 is a cam type pulley 17 which rotates with the shaft 18 when the gear 16 is rotated by the chain 12. The cam pulley arrangement has disposed thereon a suitable cable which extends in the horizontal direction forwardly of the frame and travels over conventional pulley 31 and vertically downward to a series of weights which rest on the ground but are constrained from removal or displacement by rod members 32 upon which weights 27 will ride as in a trackway. Cable 26 is attached to the weights through a bar 28 having an eyelet thereon and the amount of weights can be selected or determined by insertion of pin 45 through the weights and into member 28. Emenating forwardly and outwardly from casing 14 is a trackway denoted by numeral 5, and trackway 5 is supported on casing 14 by bolts 15. At the end remote from the casing, trackway 5 is supported on the ground through vertical pole 6 and horizontal stabilizer bar 7. Disposed on the trackway and adjustably riding thereon is a chair having a seat portion 1, a back portion 3 and hand grips disposed on either side of the seat. The distance that the seat assembly is to be from the foot platform assembly 8 can be regulated by means of knob 4 which alters the displacement of this chair on the trackway.

In operation therefore, it will be seen that once the seat has been suitably adjusted to accommodate the size of a given exerciser, the feet are placed on feet platform 8, and assuming that the appropriate weight has been selected through means of pin 45, the exerciser is free to begin. As the legs are extended forward and pressure is applied against the pedals 8, pivot bar 9 moves in an arc backwardly and at the same time extends the portion of the chain attached to pivot bar 9 in that same sense. This has the net effect of unwinding the chain off of gear 16, and of course the chain is firmly affixed at its extremities to gear 16, thereby rotating shaft 18 and cam pulley 17 which raises the weights through cable 26. When the pressure applied by the exerciser is decreased the pivot will return to its initial position by the effect of gravity on the weights. It will be appreciated that if an exerciser has selected to high a weight initially and has to let go of the pedals, the weights will descend but will not damage the machine because of the springs 46 disposed on the bottom of the weights.

Having thus described the preferred embodiment of the invention it should be understood that numerous structural modifications and adaptations may be resorted to without departing from the spirit of the invention.

What is claimed is:

1. A seated leg press machine comprising a framework, a pedal link pivoted to said framework at one extremity and terminating in a pair of foot platforms at an opposed extremity so that said pair of foot platforms lie in substantially the same horizontal plane, a seat having a back which faces said foot platforms so that work done on said foot platforms causes said pedal link to move away from said seat, a chain having an end connected to said pedal link below said platforms, a plurality of sprocket type gears which support said chain and which direct said chain ultimately to an overhead gear wheel, said overhead gear wheel is fixedly secured to a shaft which is supported on said framework and capable of rotation, and said gear wheel lies in substantially the same vertical plane as said pedal link, a cam shaped pulley disposed on said shaft, rotatable therewith and spaced from said gear wheel, a cable connecting said cam shaped pulley to a plurality of weights whose magnitude is variable so that when said pedal link is rotated said gear wheel and cam rotate therewith lifting said weights whereby as the pedal link is rotated further away from said seat the cable rides of said cam pulley along a greater radius portion thereof so that resistance from the weights increases during the latter phase of the exercise.

2. The device of claim 1 in which said seat is disposed on a trackway supported by said framework and the distance between said seat back and said foot platform is variable by moving said seat along said trackway.

3. The device of claim 2 in which a retaining pin is provided to attach securely the seat to said trackway.

4. The device of claim 2 in which there are three sprocket type gears all of which are rotatably supported on said framework, the first of which is substantially horizontally positioned between said pedal link and said seat, the second is positioned substantially vertically below said first, the third is substantially horizontally positioned with said second at the rear lower portion of said framework remote from said seat.

5. The device of claim 4 in which said first and second gears are shielded with a casing to protect the exerciser.

6. The device of claim 2 in which hand grips are provided on said seat and framework to serve as a hand support for the exerciser.

* * * * *